US011338305B2

(12) United States Patent
Rademacher et al.

(10) Patent No.: US 11,338,305 B2
(45) Date of Patent: May 24, 2022

(54) HYDROCYCLONE OVERFLOW OUTLET CONTROL DEVICE

(71) Applicant: Vulco S.A., Santiago (CL)

(72) Inventors: Marcelo Rademacher, Lane Cove North (AU); Nestor Cinotti, Elanora Heights (AU)

(73) Assignee: VULCO SA.

( * ) Notice: Subject to any disclaimer, the term of this patent is extended or adjusted under 35 U.S.C. 154(b) by 430 days.

(21) Appl. No.: 16/329,883

(22) PCT Filed: Sep. 2, 2017

(86) PCT No.: PCT/AU2017/050951
§ 371 (c)(1),
(2) Date: Mar. 1, 2019

(87) PCT Pub. No.: WO2018/039743
PCT Pub. Date: Mar. 8, 2018

(65) Prior Publication Data

US 2019/0210043 A1 Jul. 11, 2019

(30) Foreign Application Priority Data

Sep. 2, 2016 (AU) ..... 2016903535

(51) Int. Cl.
*B04C 11/00* (2006.01)
*B04C 5/13* (2006.01)
*B04C 5/12* (2006.01)

(52) U.S. Cl.
CPC ..... *B04C 11/00* (2013.01); *B04C 5/12* (2013.01); *B04C 5/13* (2013.01)

(58) Field of Classification Search
CPC ..... B04C 5/12; B04C 5/13; B04C 11/00
See application file for complete search history.

(56) References Cited

U.S. PATENT DOCUMENTS 2,849,117 A 8/1958 Rietema
4,219,380 A 8/1980 Muschelknautz et al.
(Continued)

FOREIGN PATENT DOCUMENTS

CH 238137 A 6/1945
CH 254791 A 5/1948
(Continued)

*Primary Examiner* — Michael McCullough
*Assistant Examiner* — Kalyanavenkateshware Kumar
(74) *Attorney, Agent, or Firm* — Morris O'Bryant; Compagni Cannon PLLC.

(57) ABSTRACT

The chamber (29A) of the overflow outlet control device (21A) has an inner circumferential surface which, when viewed in cross-sectional plan view, is generally in the shape of a volute, for directing material entering the chamber (29A) via the circular inlet (34) at the base portion (36) tangentially outward towards the discharge outlet (22A) located in the side wall (38). The top wall region (40) of the interior wall of the chamber (29A), a side wall portion (32) and base portion (36) together seamlessly form the chamber (29A) which is curved in shape internally. When material flows in use between the inlet (34) and the discharge outlet (22A), and passes through the central chamber (29A), it encounters no sharp corners or edges, but just smoothly curved or rounded interior wall surfaces. The top wall region (40) of the chamber (29A) also features a protruding flow control formation (42) which is joined or formed therewith, and which is arranged to extend into the chamber (29A), being directed face towards the inlet (34) such that in use the flow of material into the chamber (29A) via the inlet (34) directly encounters the formation (42).

9 Claims, 4 Drawing Sheets

(56) References Cited

U.S. PATENT DOCUMENTS

| | | | | |
|---|---|---|---|---|
| 4,581,142 | A | 4/1986 | Fladby et al. | |
| 4,842,145 | A | 6/1989 | Boadway | |
| 7,293,657 | B1 * | 11/2007 | Kelton | B04C 5/081 209/715 |
| 2005/0173335 | A1 * | 8/2005 | Rogers | B04C 5/13 210/512.1 |
| 2009/0071880 | A1 * | 3/2009 | Castro Soto | B04C 5/13 209/606 |
| 2011/0083751 | A1 * | 4/2011 | Ovesen | F15C 1/16 137/13 |

FOREIGN PATENT DOCUMENTS

| | | | |
|---|---|---|---|
| CN | 103041936 | A | 4/2013 |
| CN | 204544490 | U | 8/2015 |

* cited by examiner

Table 3-1: Testing Results.

| Device | α | %α | d50c | %d50c | W Bp | %W Bp | Bp f | %Bp f |
|---|---|---|---|---|---|---|---|---|
| Donnuts shape ACB | 4.49 | -1.32 | 126.81 | -8.98 | 12.39 | -10.28 | 11.64 | -3.68 |
| Case Base | 4.55 | | 139.32 | | 13.81 | | 12.28 | |

HYDROCYCLONE OVERFLOW OUTLET CONTROL DEVICE

TECHNICAL FIELD

This disclosure relates generally to hydrocyclones and more particularly, but not exclusively, to hydrocyclones suitable for use in the mineral and chemical processing industries. The disclosure is also concerned with the design of hydrocyclones as a means of optimising their performance.

BACKGROUND OF THE DISCLOSURE

Hydrocyclones are used for separating suspended matter carried in a flowing liquid such as a mineral slurry into two discharge streams by creating centrifugal forces within the hydrocyclone as the liquid passes through a conical shaped chamber. Basically, hydrocyclones include a conical separating chamber, a feed inlet which is usually generally tangential to the axis of the separating chamber and is disposed at the end of the chamber of greatest cross-sectional dimension, an underflow outlet at the smaller end of the chamber, and an overflow outlet at the larger end of the chamber.

The feed inlet is adapted to deliver the liquid containing suspended matter into the hydrocyclone separating chamber, and the arrangement is such that the heavy (for example, denser and coarser) matter tends to migrate towards the outer wall of the chamber and towards and out through the centrally located underflow outlet. The lighter (less dense or finer particle sized) material migrates towards the central axis of the chamber and out through the overflow outlet. Hydrocyclones can be used for separation by size of the suspended solid particles or by particle density. Typical examples include solids classification duties in mining and industrial applications.

For enabling efficient operation of hydrocyclones the internal geometric configuration of the larger end of the chamber where the feed material enters, and of the conical separating chamber are important. In normal operation such hydrocyclones develop a central air column, which is typical of most industrially-applied hydrocyclone designs. The air column is established as soon as the fluid at the hydrocyclone axis reaches a pressure below the atmospheric pressure. This air column extends from the underflow outlet to the overflow outlet and simply connects the air immediately below the hydrocyclone with the air at the top. The stability and cross sectional area of the air core is an important factor in influencing the underflow and overflow discharge condition, to maintain normal hydrocyclone operation.

During normal "stable" operation, the slurry enters through an upper inlet of a hydrocyclone separation chamber in the form of the inverted conical chamber to become separated cleanly. However, the stability of a hydrocyclone during such an operation can be readily disrupted, for example by collapse of the air core due to overfeeding of the hydrocyclone, resulting in an ineffective separation process, whereby either an excess of fine particulates exit through the lower outlet or coarser particulates exit through the upper outlet.

Another form of unstable operation is known as "roping", whereby the rate of solids being discharged through the lower outlet increases to a point where the flow is impaired. If corrective measures are not timely adopted, the accumulation of solids through the outlet will build up in the separation chamber, the internal air core will collapse and the lower outlet will discharge a rope-shaped flow of coarse solids.

Unstable operating conditions can have serious impacts on downstream processes, often requiring additional treatment (which, as will be appreciated, can greatly impact on profits) and also result in accelerated equipment wear. Hydrocyclone design optimisation is desirable for a hydrocyclone to be able to cope with changes to the composition and viscosity of input slurry, changes in the flowrate of fluid entering the hydrocyclone, and other operational instabilities.

SUMMARY

In a first aspect, embodiments are disclosed of an overflow outlet control device for a hydrocyclone, the device including:

a base portion including an inlet;

a top wall; and a side wall extending between the base portion and the top wall, the side wall including an outlet;

the side wall, base portion and top wall together defining an outlet flow control chamber;

the inlet being arranged to receive a flow of material from an overflow outlet of an adjacent hydrocyclone, such that in use the flow of material passes through the chamber and leaves by way of the outlet; and wherein an interior surface of the chamber located at the top wall includes a flow control formation which extends into the chamber towards the inlet, the flow control formation including an enlarged end portion and a narrowed portion disposed between the end portion and the top wall.

The use of an improved configuration of overflow outlet control device has been found to produce some metallurgically beneficial outcomes during its operation, as measured by various standard classification parameters. These beneficial outcomes include a reduction both in the amount of water, and in the amount of fine particles, which bypass the classification step and which are improperly carried away in the cyclone coarse particle underflow discharge stream, rather than reporting to the fine particle overflow stream as should be the case during optimal cyclone operation. Also observed was a reduction in the average particle cut size (d50%) in the overflow stream from the classification step, as a consequence of more fine particles now reporting to the fine particle overflow stream.

The inventors surmise that the use of an overflow outlet control device to assist in the separation of fine particles from coarser particles can also enable operational advantages in related processes, for example an improvement in the recovery performance in a downstream flotation process. An increase in the amount of fine particles in the flotation feed can lead to better liberation and flotation separation of valuable materials in a subsequent process step. Also, reducing the amount of recirculating load of particle material in the milling and cyclone separation circuit can avoid overgrinding of particles which are already sufficiently finely ground, as well as increasing the capacity of the grinding circuit because unnecessary regrinding wastes energy in the milling circuit. Overall the inventors expect that the use of an overflow outlet control device in conjunction with the hydrocyclone separation step will so maximise throughput of product in terms of, for example, tonnage per hour, and maintain the physical separation process parameters at a stable level.

In certain embodiments, the flow control formation is radially symmetrical.

In certain embodiments, the enlarged end portion of the flow control formation includes a convex region which faces towards the inlet.

In certain embodiments, the flow control formation progressively narrows in a direction from the top wall to the narrowed portion and progressively widens in a direction from the narrowed portion to the enlarged end portion. In one form of this, the narrowed portion is a concave region of the flow control formation.

In certain embodiments, the end portion of the flow control formation terminates at a position closer to the inlet than to the interior surface of the chamber located at the top wall.

In certain embodiments, the interior surface of the side wall of the flow control chamber is rounded in shape. In one form of this, the rounded interior surface of the side wall of the chamber is in the shape of a toms.

In certain embodiments, an axis of the outlet from the chamber is arranged to be generally perpendicular to an axis of the inlet of the chamber.

In certain embodiments, the chamber is generally volute-shaped in cross-section when viewed in a plane in which the axis of the outlet is located.

Also disclosed herein are embodiments of an overflow outlet control device for a hydrocyclone, the device including:

a base portion including an inlet;

a top wall; and a side wall extending between the base portion and the top wall, the side wall including an outlet;

the side wall, base portion and top wall together defining an outlet flow control chamber;

the inlet being arranged to receive a flow of material from an overflow outlet of an adjacent hydrocyclone, such that in use the flow of material passes through the chamber and leaves by way of the outlet; and wherein an interior surface of the chamber located at the top wall includes a flow control formation which extends into the chamber towards the inlet, terminating at a position closer to the inlet than to the interior surface.

The use of an overflow outlet control device using such a configuration of flow control formation has been found to promote a stable cyclone discharge flow, minimise any back pressure on the cyclone system process, maximise the cross-sectional area of the central axial air core generated within the cyclone, maximise throughput of product in terms of, for example, tonnage per hour, and maintain the physical separation process parameters at a stable level.

In certain embodiments, the flow control formation including an enlarged end portion and a narrowed portion disposed between the end portion and the top wall.

In certain embodiments, this overflow outlet control device for a hydrocyclone is otherwise as defined by the features of the first aspect.

In a second aspect, embodiments are disclosed of overflow outlet control device for a hydrocyclone, the device including:

a base portion including an inlet;

a top wall; and a side wall extending between the base portion and the top wall, the side wall including an outlet;

the side wall, base portion and top wall together defining an outlet flow control chamber;

the inlet being arranged to receive a flow of material from an overflow outlet of an adjacent hydrocyclone, such that in use the flow of material passes through the chamber and leaves by way of the outlet; and wherein an interior surface of the side wall of the chamber is rounded in shape.

The use of an overflow outlet control device featuring such a configuration of the interior surface of the side wall of the chamber has been found to promote a stable cyclone discharge flow, minimise any back pressure on the cyclone system process, maximise the cross-sectional area of the central axial air core generated within the cyclone, maximise throughput of product in terms of, for example, tonnage per hour, and maintain the physical separation process parameters at a stable level.

In certain embodiments, when the device is viewed in vertical cross-section, the so rounded interior surface of the side wall of the chamber is configured to curve outwardly and then to curve inwardly, when moving in a direction from the base portion to the top wall.

In certain embodiments, the rounded interior surface of the side wall of the chamber is in the shape of a toms.

In certain embodiments, an interior surface of the chamber located at the top wall includes a flow control formation which extends into the chamber towards the inlet, terminating at a position closer to the inlet than to the interior surface.

In certain embodiments, an interior surface of the chamber located at the top wall includes a flow control formation which extends into the chamber towards the inlet, the flow control formation including an enlarged end portion and a narrowed portion disposed between the end portion and the top wall.

In certain embodiments, the overflow outlet control device for a hydrocyclone of the second aspect, is otherwise as defined by the features of the first aspect.

Other aspects, features, and advantages will become apparent from the following detailed description when taken in conjunction with the accompanying drawings, which are a part of this disclosure and which illustrate, by way of example, principles of the inventions disclosed.

DESCRIPTION OF THE FIGURES

The accompanying drawings facilitate an understanding of the various embodiments which will be described.

DETAILED DESCRIPTION

Figure 1:
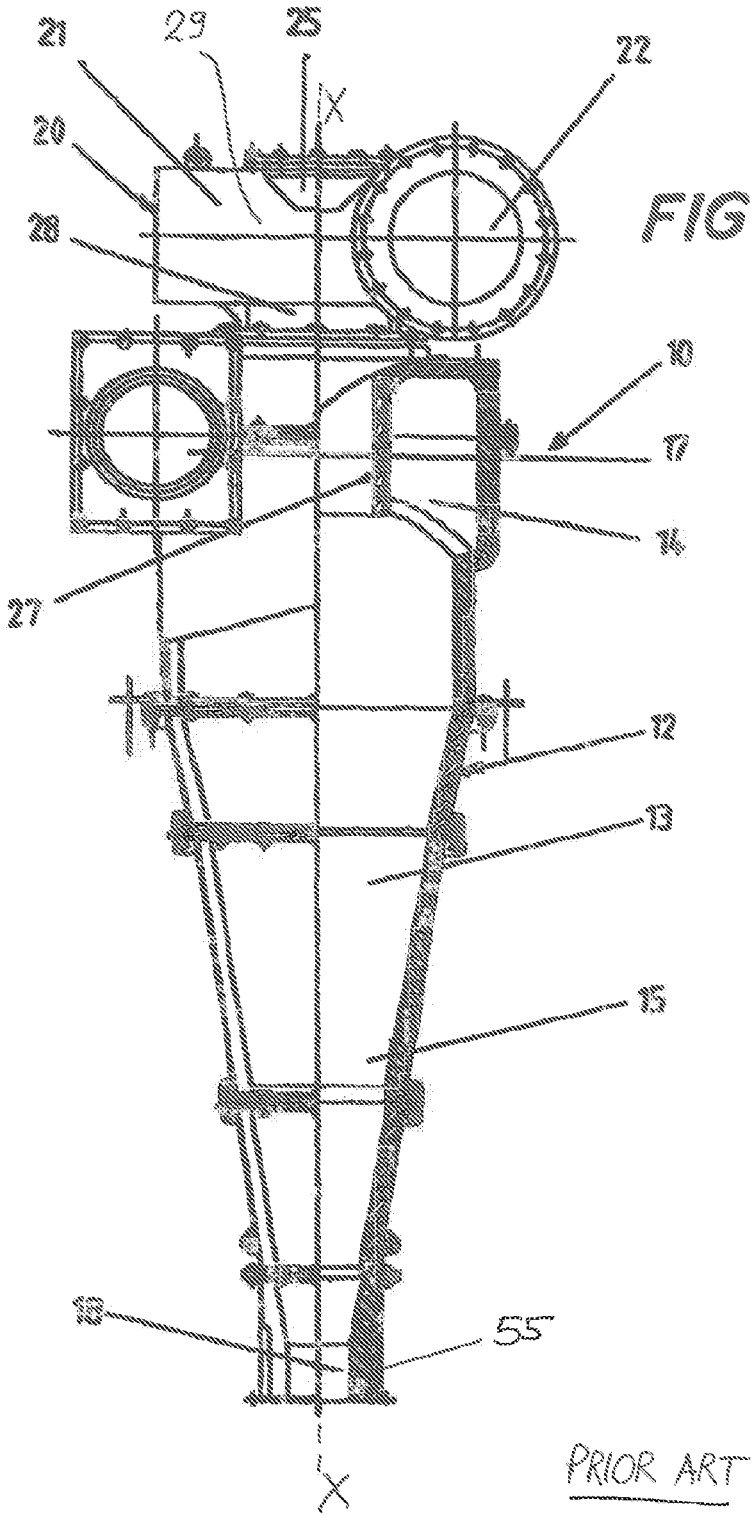
FIG. 1 PRIOR ART
FIG. 1 is a part-sectional schematic view of a prior art hydrocyclone (from U.S. Pat. No. 7,255,790, assigned to a company that is related to the present applicant)

This disclosure relates to the design features of a hydrocyclone of the type that facilitates separation of a liquid or semi-liquid material mixture into two phases of interest. The hydrocyclone has a design which enables a stable operation, with maximised throughput and good physical separation process parameters.

A hydrocyclone, when in use, is normally orientated with its central axis X-X being disposed upright, or close to being upright. Referring to the drawings, there is shown a hydrocyclone generally indicated at 10 which includes a main body 12 having a chamber 13 therein, the chamber 13 including an inlet (or feed) section 14, and a conical separating section 15. The hydrocyclone 10 further includes a cylindrical feed inlet port 17 of circular cross-section, in use for feeding a material mixture, typically a particle-bearing slurry mixture, into the inlet section 14 of the chamber 13.

An overflow outlet or vortex finder 27, typically in the form of a cylindrical, short length of pipe, is provided at one end of the chamber 13 adjacent the inlet section 14 thereof, and an underflow outlet 18 at the other end of the chamber, remote from the inlet section 14 of the chamber 13.

The hydrocyclone 10 further includes a control unit 20 having an overflow outlet control device 21 located adjacent to the inlet section 14 of the chamber 13 of the so hydrocyclone 10 and in communication therewith via the overflow outlet 27. The overflow outlet control device 21 includes a central chamber 29, and a tangentially located, circular cross-sectional discharge outlet 22 leading out from the central chamber 29, and a centrally located air core stabilising orifice 25 which is remote from the overflow outlet 27, across the other side of the central chamber 29. The stabilising orifice 25, overflow outlet 27 and underflow outlet 18 are generally axially aligned along the axis X-X of the hydrocyclone 10.

The central chamber 29 of the overflow outlet control device 21 has an inner surface which when viewed in cross-sectional plan view is generally in the shape of a volute, for directing material entering the chamber 29 of the overflow outlet control device 21 outward towards the discharge outlet 22. Preferably, the volute shape of the inner surface subtends an angle of up to 360°.

The inlet section 14 of the chamber 13 of the hydrocyclone 10 has an inner surface, which is generally in the shape of a volute and preferably the volute is ramped axially toward the converging end of the separation chamber and extends around the inner surface for up to 360°.

The stabilising orifice 25 comprises tapering side walls which extend a short distance into the central chamber 29, which as shown in FIG. 1 forms a generally conical shaped inlet section. The control unit 20 may be integral with the hydrocyclone 10 or separate therefrom so that it enables it to be retrofitted to existing hydrocyclones.

The underflow outlet (hereafter "lower outlet") 18 is centrally located at the other end of the chamber 13 (that is, at the apex of the conical separating section 15) being remote from the inlet section 14, in use for discharge of a second one of the phases. The underflow outlet 18 shown in the drawings is the open end of the conical separating section 15. In the hydrocyclone 10 in use, material passing via the underflow outlet 22 flows into a further section in the form of a cylindrical length of pipe known as a spigot 55.

The hydrocyclone 10 is arranged in use to generate an internal air core around which the slurry circulates. During stable operation, the hydrocyclone 10 operates such that a lighter solid phase of the slurry is discharged through the uppermost overflow outlet 27 and a heavier solid phase is discharged through the lower underflow outlet 18, and then via the spigot 55. The internally-generated air core runs the length of the main body 12.

Referring now to the features of the overflow outlet control device of the present disclosure, reference will be made to FIGS. 2 to 6. In this embodiment of the device, if a part performs a similar function to a part which has already been described in relation to prior art hydrocyclones or to prior art overflow outlet control devices, then it has been given the same part number designation followed by the letter "A".

Figure 3:
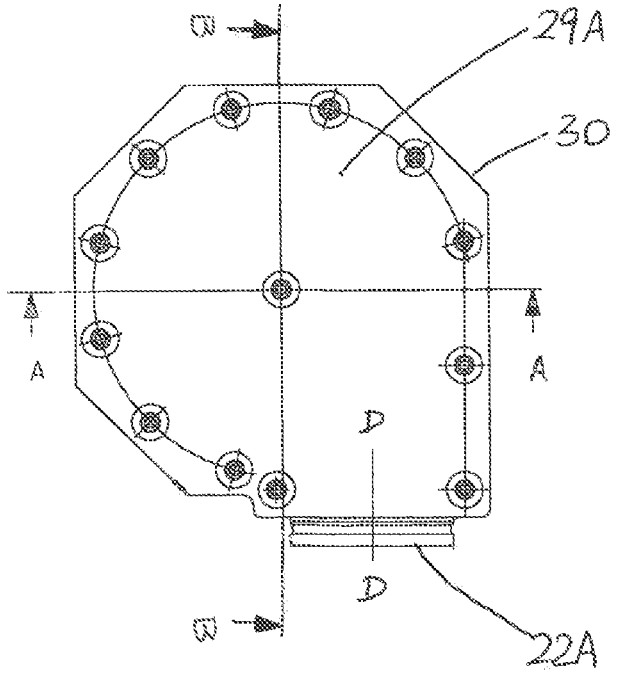
FIG. 3 is a schematic plan view of the overflow outlet control device according to FIG. 2.

The hydrocyclone overflow outlet control device 21A includes a central chamber 29A, which has interior wall surfaces which are rounded in shape, and located within (or as part of) an exterior housing 30 which is generally octagonal when viewed in plan (as can be seen in FIG. 3). As presented in FIG. 4 and FIG. 6, the shape of the interior wall surface of the chamber 29A is in the mathematical shape of a toms—that is, the shape of the chamber cavity 29A is defined by rotation of a circle around a central axis to product a circular section ring (a surface of revolution with a hole in the middle like a doughnut).

Rather than being of a specific mathematical form, in other embodiments, the shape of the interior wall surface of the chamber 29A, when the device is viewed in vertical cross-section, can simply be configured firstly to curve outwardly and then subsequently to curve inwardly again, when moving in a direction from the base portion to the top wall, and thus to provide a smooth flow path for the liquid and solid materials moving through the chamber 29A, as will shortly be described.

In the chamber 29A, there is a circular inlet 34 located in the base portion 36 and which is connected to the overflow outlet 27 of the adjacent cyclone (not shown), the inlet 34 being arranged to receive a flow of material from the overflow outlet 27 which, in use, passes in and through the chamber 29A, exiting via the circular cross-sectional discharge outlet 22A located in a side wall 38. The chamber 29A of the overflow outlet control device 21A has an inner circumferential surface which, when viewed in cross-sectional plan view (as can be seen in FIG. 3), is generally in the shape of a volute, for directing material entering the chamber 29A via the circular inlet 34 at the base portion 36 tangentially outward towards the discharge outlet 22A located in the side wall 38.

The top wall region 40 of the interior wall of the chamber 29A has an area which is located opposite to the base portion 36 of the device 21A, which itself includes the circular inlet 34. The top wall region 40, a side wall portion 32 and base portion 36 together seamlessly form the chamber 29A which is shaped internally as a torus in the embodiment shown in FIG. 4 and FIG. 6. When material flows in use between the inlet 34 and the discharge outlet 22A, and passes through the central chamber 29A, it encounters no sharp corners or edges, but just smoothly curved or rounded interior wall surfaces.

The top wall region 40 of the chamber 29A also features a protruding flow control formation 42 which is joined or formed therewith, and which is arranged to extend into the chamber 29A, being directed face towards the inlet 34 such that in use the flow of material into the chamber 29A via the inlet 34 directly encounters the formation 42. As a result of its shape, the formation 42 functions to smoothly deflect and direct the material flow therearound, and to circulate it into the chamber 29A.

Figure 4:
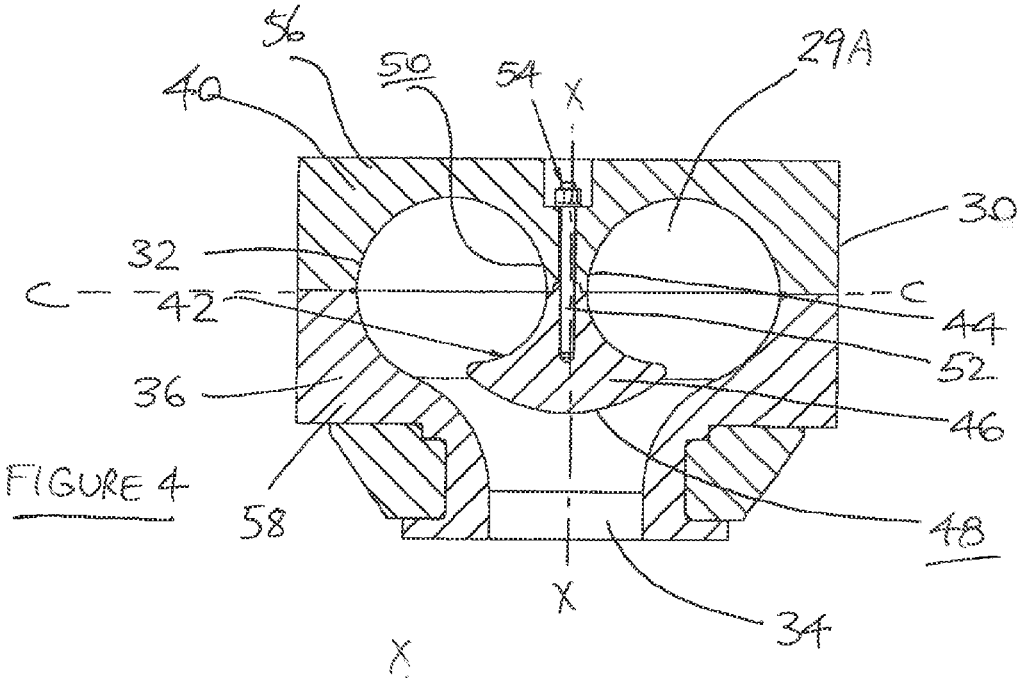
FIG. 4 is a schematic, cross-sectional side view of the overflow outlet control device of FIG. 3, when viewed along sectional plane A-A.
Figure 6:
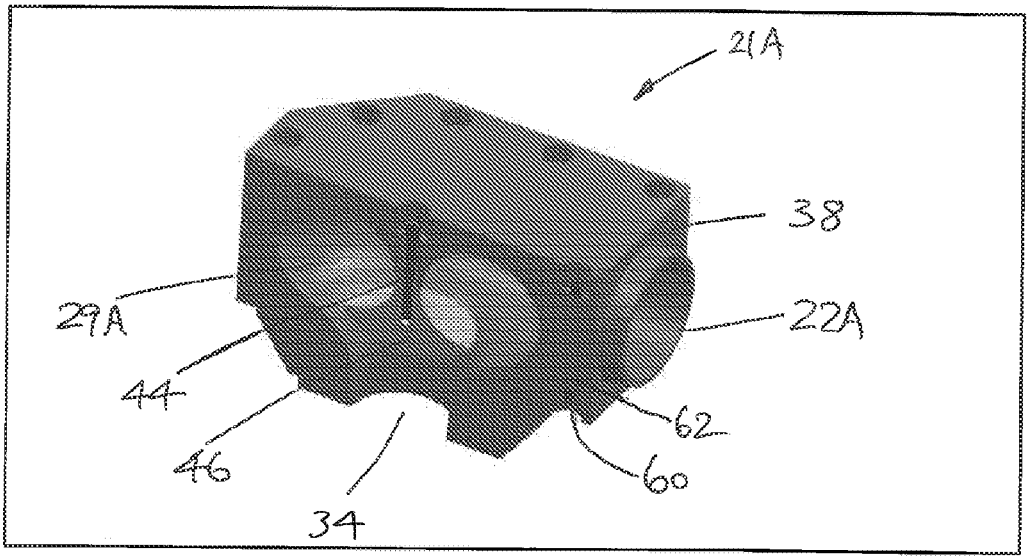
FIG. 6 is a perspective, cross-sectional view of the overflow outlet control device of FIG. 2 and FIG. 3 when viewed along sectional plane B-B.

As shown in FIG. 4 and FIG. 6, the flow control formation 42 is generally in the shape of a symmetrical, narrow elongate neck or stem 44, and having an enlarged end head 46, which is joined to the top wall region 40 by the narrow neck 44. The enlarged end head 46 has a convex face 48 which is directed to face downwardly towards the inlet 34. In the embodiment shown, the narrow neck portion 44 is radially symmetrical about the axis X-X and has a generally tapering, and then widening shape with concave sides 50 therearound, when moving in a direction downward from the top wall region 40.

Figure 2:
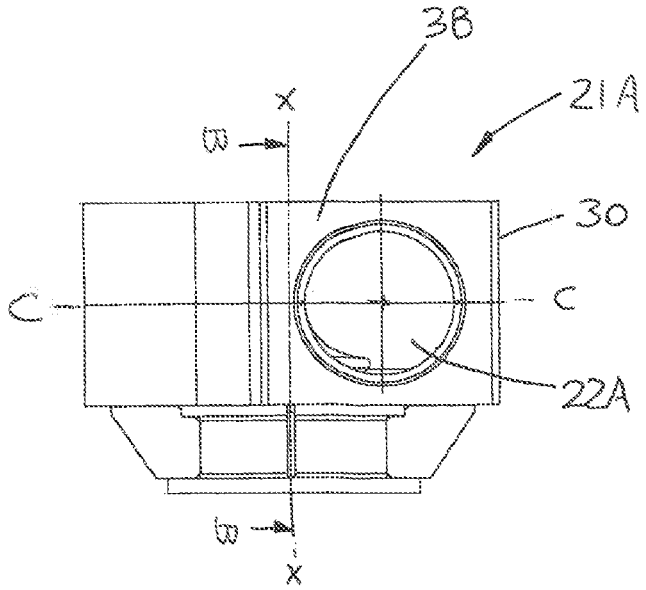
FIG. 2 is a schematic side view of an overflow outlet control device when viewed in the direction of the outlet of the device, the device being in accordance with a first embodiment of the present disclosure.

The convex face 48 at the end of the enlarged head 46 is located at a distance into the chamber 29A which is closer to the inlet 34 than it is to the interior surface of the top wall region 40—in other words, the convex face 48 extends below a horizontal midpoint of the control chamber 29A which is indicated by line C-C in FIGS. 2 and 4. This means that the convex face 48 is placed in a direct flow path of the material entering into the chamber 29A when in use, and the centre of the convex face is the first portion of the flow control device 21A to encounter the material flow, which then serves to redirect that flow towards the rounded interior walls of the chamber 29A.

Along the X-X axis of the hydrocyclone therefore also lies the inlet 34, as well as the principal axis of the narrow neck 44 and of the enlarged head 46 located within the chamber 29A of the overflow outlet control device 21A. When material flow exits the central chamber 29A via the discharge outlet 22A, the axis D-D of the discharge outlet 22A is generally perpendicular to the axis X-X. The material flow in the chamber 29A therefore experiences a perpendicular change in direction between entry and exit, but the rounded internal walls of the chamber 29A, as well as the rounded surfaces of the convex face 48 of the enlarged head 46 and of the concave side wall 50 of the narrow neck 44, all serve in conjunction to reduce the turbulence of the flow as much as possible, leading to more stable operating conditions in the adjacent hydrocyclone.

The convex face 48 of the enlarged head 46 creates a narrow opening area, and thus a higher velocity for the slurry as it moves into the central chamber 29A. As well as that, the shape of the convex face 48 maintains the slurry in the chamber 29A and prevents it from returning into the hydrocyclone below, as well as providing smooth passage of that slurry without generation of turbulence. In turn, this improves the metallurgical performance of the hydrocyclone.

Referring to FIG. 4, the enlarged head 46 is attached through the narrow neck 44 to the top wall region 40 by means of an elongate fixing bolt 52 and nut 54 arrangement. In other embodiments, the enlarged head can be directly formed with the narrow neck, and the neck is then attached at its uppermost in use end to the top wall region 40.

Figure 5:
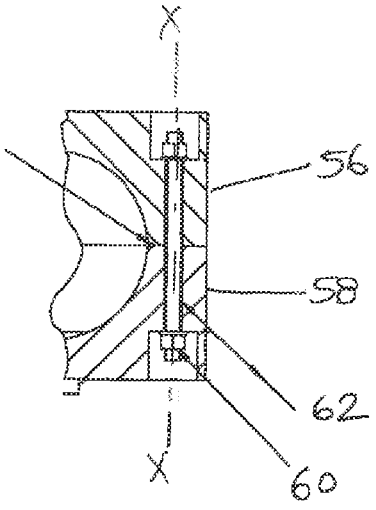
FIG. 5 is a detail of the cross-sectional side view of FIG. 6 when viewed along sectional plane B-B.

Referring to FIG. 5, the upper 56 and lower 58 half portions of the overflow outlet control device 21A are joined together by a plurality of circumferentially spaced nut 60 and bolt 62 fastening arrangements located around the perimeter of the device 21A, which is also shown in FIG. 6. The device 21A may therefore be cast or molded in two portions which are subsequently joined together, and the enlarged head and narrow neck parts of the flow control formation can be fitted to the upper portion 56 prior to the two portions 56, 58 being connected.

In the embodiment shown, the neck 44 and head 46 formation is radially symmetrical about the central axis X-X of the hydrocyclone, however in further embodiments, the flow control formation can be of other shapes and configurations which serve to smoothly deflect the flow of inlet material into the overflow outlet control device.

The shape and configuration of the walls of the internal chamber 29A and of the flow control formation 42 serve to allow the free flow of material through the overflow outlet control device 21A, reducing turbulence because of all the rounded surfaces which are presented to the material flow.

In certain other embodiments, it is possible to operate a cyclone overflow outlet control device of this type without all of the aforementioned surfaces being curved in each embodiment. For example, the flow control formation can still have the convex face 48 placed in a direct flow path of the material entering into the chamber 29A when in use, so that the centre of the convex face is the first portion of the flow control device 21A to encounter the material flow, and to redirect it as described. However, in that same example, the feature of the enlarged head and narrow neck parts of the flow control formation may not be curved - the narrow neck could simply be cylindrical and the enlarged head arranged to extend out from that neck in a tapered manner (rather than being curved). Whilst all surfaces are still smooth, and without sharp edges or disjointed portions, they are not all curved in the manner shown in FIG. 4 and FIG. 6.

In certain other embodiments, the flow control formation may have some different features of shape at the enlarged head region, but this time the concave side wall 50 of the narrow neck 44 could be in place, to serve to reduce the turbulence of the flow as much as possible in the chamber, leading to more stable operating conditions in the adjacent hydrocyclone.

Experimental Results

Experimental results have been produced by the inventors using the new equipment configuration disclosed herein, to assess whether there are any metallurgically beneficial outcomes during the operation of the hydrocyclone, in comparison with the baseline case (without the new configuration).

Table 1-1 shows the results of various experiments in which an overflow outlet control device 21A is located at the uppermost position atop a hydrocyclone 10, that is connected to the cyclone overflow outlet via the vortex finder 27, compared to a situation without.

The parameters which were calculated included: the percentage (%) change in the amount of water bypass (WBp); and the percentage (%) change in the amount of fine particles (Bpf) which bypass the classification step. In a poorly-operating hydrocyclone, some water and fine particles are improperly carried away in the cyclone coarse particle underflow (oversize) discharge stream, rather than reporting to the fine particle overflow stream, as should be the case during optimal cyclone operation. The parameters WBp and Bpf provide a measure of this.

Also observed was the percentage (%) change in the average particle cut size (d50) in the overflow stream from the classification step, as a measure of whether more or less fine particles reported to the fine particle overflow stream. Particles of this particular size d50, when fed to the equipment, have the same probability of reporting to either the underflow or to the overflow.

Also observed was a quantification of the efficiency factor of classification of the hydrocyclone, in comparison with a calculated 'ideal classification'. This parameter alpha (cc) represents the acuity of the classification. It is a calculated value, which was originally developed by Lynch and Rao (University of Queensland, JK Minerals Research Centre, JKSimMet Manual). The size distribution of particulates in a feed flow stream is quantified in various size bands, and the percentage in each band which reports to the underflow (oversize) discharge stream is measured. A graph is then drawn of the percentage in each band which reports to underflow (as ordinate, or Y-axis) versus the particle size range from the smallest to the largest (as abscissa, or X-axis). The smallest particles have the lowest percentage reporting to oversize. At the d50 point of the Y-axis, the slope of the resultant curve gives the alpha ($\alpha$) parameter. It is a comparative number which can be used to compare classifiers. The higher the value of the alpha parameter, the better the separation efficiency will be.

When comparing the use of the overflow outlet control device having an internal chamber in accordance with the present disclosure with a hydrocyclone which does not have any overflow outlet control chamber, the data in Table 1-1 demonstrates:

- a 10.3% reduction in the amount of water bypassing (WBp) the hydrocyclone classification by ending up in the underflow stream;
- a slight (3.6%) reduction in the amount of fine particles (Bpf) which bypassed the classification step by ending up in the underflow stream;
- a 9.0% reduction the average particle cut size (d50) in the overflow stream from the classification step; and
- a very slight (1.3%) reduction in the a separation efficiency parameter, which represents no real change.

In summary, overall the best results were observed in the improvements to the water bypass (WBp), and to the average particle cut size (d50) of the solid-liquid mixture flowing through a hydrocyclone using an overflow outlet control device of the present disclosure—that is, there was both a reduction in the amount of water bypassing (WBp) the hydrocyclone and ending up in the underflow stream, and also a reduction in the average particle cut size (d50) in the overflow stream.

The inventors surmise that the overflow outlet control device disclosed herein can be most useful in those situations where a narrower classification of a product by size is the predominant requirement.

The inventors have discovered that the use of the a hydrocyclone separation apparatus fitted with the overflow outlet control device of the present disclosure can realise optimum (and stable) operating conditions therein, and this physical configuration has been found to:

- promote better liberation of fine particles, and thus better recovery in a downstream flotation process, thereby maximising throughput;
- minimise the recirculating load of particle material in the hydrocyclone underflow which is being returned to a milling step, and thus avoid overgrinding of particles, thus saving energy;
- maximise throughput of product in terms of, for example, tonnage per hour; and
- maintain the physical separation process parameters at a stable level.

In the foregoing description of certain embodiments, specific terminology has been resorted to for the sake of clarity. However, the disclosure is not intended to be limited to the specific terms so selected, and it is to be understood that each specific term includes other technical equivalents which operate in a similar manner to accomplish a similar technical purpose. Terms such as "upper" and "lower", "above" and "below" and the like are used as words of convenience to provide reference points and are not to be construed as limiting terms.

In this specification, the word "comprising" is to be understood in its "open" sense, that is, in the sense of "including", and thus not limited to its "closed" sense, that is the sense of "consisting only of". A corresponding meaning is to be attributed to the corresponding words "comprise", "comprised" and "comprises" where they appear.

The preceding description is provided in relation to several embodiments which may share common characteristics and features. It is to be understood that one or more features of any one embodiment may be combinable with one or more features of the other embodiments. In addition, any single feature or combination of features in any of the embodiments may constitute additional embodiments.

In addition, the foregoing describes only some embodiments of the inventions, and alterations, modifications, additions and/or changes can be made thereto without departing from the scope and spirit of the disclosed embodiments, the embodiments being illustrative and not restrictive. For example, the flow control formation may be made up of a number of pieces joined together in various ways to one another (for example, not just by nuts and bolts but by other types of fastening means. The materials of construction of the casing of the overflow outlet control device, whilst typically made of hard plastic or metal, can also be of other materials such as ceramics. The interior lining material of the device can be rubber or other elastomer, or ceramics, formed into the required internal shape geometry of the chamber, as specified herein.

Furthermore, the inventions have described in connection with what are presently considered to be the most practical and preferred embodiments, it is to be understood that the invention is not to be limited to the disclosed embodiments, but on the contrary, is intended to cover various modifications and equivalent arrangements included within the spirit and scope of the inventions. Also, the various embodiments described above may be implemented in conjunction with other embodiments, e.g., aspects of one embodiment may be combined with aspects of another embodiment to realise yet other embodiments. Further, each independent feature or component of any given assembly may constitute an additional embodiment.

The invention claimed is:

1. An overflow outlet control device for a hydrocyclone, the device including:

- a base portion including an inlet;
- a top wall; and
- a side wall extending between the base portion and the top wall, the side wall including an outlet;
- the side wall, base portion and top wall together defining an outlet flow control chamber;
- the inlet being arranged to receive a flow of material from an overflow outlet of an adjacent hydrocyclone, such that in use the flow of material passes through the chamber and leaves by way of the outlet and the material flow in the chamber experiences a perpendicular change in direction between the inlet and the outlet; and
- wherein an interior surface of the chamber located at the top wall includes a flow control formation which extends into the chamber towards the inlet, the flow control formation including an enlarged end portion and a narrowed portion disposed between the end portion and the top wall;
- wherein the enlarged end portion of the flow control formation includes a curved convex region which faces towards the inlet.

2. The overflow control device according to claim 1, wherein the flow control formation is radially symmetrical.

3. The overflow outlet control device according to claim 1, wherein the flow control formation progressively narrows in a direction from the top wall to the narrowed portion and progressively widens in a direction from the narrowed portion to the enlarged end portion.

4. The overflow control device according to claim 3, wherein the narrowed portion is a concave region of the flow control formation.

5. The overflow outlet control device according to claim 1, wherein the end portion of the flow control formation terminates at a position closer to the inlet than to the interior surface of the chamber located at the top wall.

6. The overflow control device according claim 1, wherein the interior surface of the side wall of the flow control chamber is rounded in shape.

7. The overflow control device according to claim 6, wherein the rounded interior surface of the side wall of the chamber is in the shape of a torus.

8. The overflow control device according to claim 1, wherein an axis of the outlet from the chamber is arranged to be generally perpendicular to an axis of the inlet of the chamber.

9. The overflow control device according to claim 8, wherein the chamber is generally volute-shaped in cross-section when viewed in a plane in which the axis of the outlet is located.

* * * * *